US007397008B2

(12) United States Patent
Ahn et al.

(10) Patent No.: US 7,397,008 B2
(45) Date of Patent: Jul. 8, 2008

(54) SWITCHING MECHANISM FOR AIR CIRCUIT BREAKER

(75) Inventors: Kil-Young Ahn, Daejeon (KR); Hong-Ik Yang, Chungcheongbuk-Do (KR); Sang-Chul Lee, Chungcheongbuk-Do (KR); Ki-Hwan Kim, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 11/870,704

(22) Filed: Oct. 11, 2007

(65) Prior Publication Data

US 2008/0088396 A1 Apr. 17, 2008

(30) Foreign Application Priority Data

Oct. 17, 2006 (KR) ..... 10-2006-0101052

(51) Int. Cl.
*H01F 5/00* (2006.01)

(52) U.S. Cl. ..... 200/400; 200/401

(58) Field of Classification Search ..... 335/6, 335/8, 21, 167, 171, 189–191; 200/337, 200/400, 401

See application file for complete search history.

(56) References Cited

U.S. PATENT DOCUMENTS 6,064,021 A * 5/2000 Wehrli et al. ..... 200/400
6,080,947 A * 6/2000 Ulerich et al. ..... 200/308
6,160,234 A * 12/2000 Wehrli et al. ..... 200/400
2006/0086693 A1 4/2006 Yeon
2006/0119455 A1 6/2006 Park
2006/0131145 A1 6/2006 Suh
2007/0075047 A1 4/2007 Oh
2007/0075808 A1 4/2007 Ahn

OTHER PUBLICATIONS

U.S. Appl. No. 11/870,763 to Yang et al., filed Oct. 11, 2007.
U.S. Appl. No. 11/870,665 to Seo, filed Oct. 11, 2007.

* cited by examiner

*Primary Examiner*—Ramon M Barrera
(74) *Attorney, Agent, or Firm*—Greenblum & Bernstein, P.L.C.

(57) ABSTRACT

A switching mechanism of an air circuit breaker that allows the overall size of the air circuit breaker to be minimal by making the width of the switching mechanism relatively small. The switching mechanism of the air circuit breaker includes both side plates, a main shaft, a main shaft lever, a first link, a closing spring unit, a charging cam, a rotational shaft of the charging cam, a third link, a driving lever, a spring support pin and an end portion supported by the spring support pin, and a third link elastic bias spring having an end portion supported by the spring support pin and an operation portion for providing elastic force onto one surface of the third link to bias the third link to be rotated in one direction. A third link elastic bias spring directly provides the elastic force onto the third link in order to minimize the distance between a pair of driving levers and thus minimize the width of the switching mechanism.

4 Claims, 12 Drawing Sheets

SWITCHING MECHANISM FOR AIR CIRCUIT BREAKER

BACKGROUND OF THE INVENTION

1. Field of the Invention

The present invention relates to a switching mechanism of an air circuit breaker, a type of a low voltage circuit breaker, and more particularly, to a switching mechanism of an air circuit breaker that allows the overall size of the air circuit breaker to be compact by making the width of the switching mechanism relatively small.

2. Description of the Related Art

The air circuit breaker includes a switching mechanism that opens or closes a current conduction circuit, a cradle unit for housing the switching mechanism and having a terminal part connected with an external power source and a load, and a circuit monitoring and controlling unit that senses a fault current of the current conduction circuit as connected and provides a driving power for automatically driving the switching mechanism to a breaking (trip) position.

The present invention relates to the switching mechanism, which is called as a main circuit part of the major parts of the air circuit breaker, and the related art will now be described.

The switching mechanism of the air circuit breaker according to the related art will be described with reference to FIGS. 1 to 5 and 8.

First, the construction of the switching mechanism of the air circuit breaker according to the related art will be described with reference to FIGS. 1 and 2.

As shown in FIG. 1, the switching mechanism of the air circuit breaker according to the related art includes a stationary contactor 12 and a movable contactor 11 which is movable to a closing position at which the movable contactor 11 contacts with the stationary contactor 12 to close the circuit and a breaking (trip) position at which the movable contactor 11 is separated from the stationary contactor 12 to open the circuit.

As shown in FIG. 1, the movable contactor 11 is connected with a main shaft lever 10-1 and driven such that it comes in contact with the stationary contactor 12 or separated from the stationary contactor 12 according to a rotational direction of the main shaft lever 10-1.

The main shaft lever 10-1 is generally used when the air circuit breaker opens and closes 3 phases alternating current conducting lines, so three main shaft levers 10-1 are provided to correspond to each phase and drive the movable contactor 11 of a corresponding phase.

In order to simultaneously drive the three main shaft levers 10-1, the respective main shaft levers 10-1 are coaxially connected with a single common main shaft 10.

Accordingly, the main shaft 10 penetrates both side plates 1 supporting the switching mechanism so as to extend to be connected with the main shaft lever 10-1 of a different phase.

Among the main shaft levers 10-1, the central main shaft lever 10-1 connected with the switching mechanism has one end connected with the main shaft 10 and the other end connected with a first link 6.

Like gears which have a different rotational shaft and are in mesh with each other, one end of the first link 6 is connected with the main shaft lever 10-1, and the main shaft lever 10-1 and the first link 6 are rotated in the mutually opposite directions. The first link 6 provides a driving force to the central main shaft lever 10-1, among the three main shaft levers 10-1, to allow the central main shaft lever 10-1 to drive the movable contactor 11 to an opening or closing position.

A second link 4 is connected with the other end of the first link 6, and the first and second links 6 and 4 are rotated in the same direction.

One end of a third link 3 is rotatably provided at the other end of the second link 4 and connected by a driving connection pin (P) to transfer the driving force to the second link 4.

A closing spring unit includes a closing spring 13 for providing a driving force to drive the movable contactor 11 to the closing position and a closing spring seat (no reference numeral is given). The closing spring 13 charges elastic energy and discharges it to provide a driving force to allow the movable contactor 11 to be driven to the closing position.

In order to prevent the closing spring 13 from being released and support the rotation of the closing spring seat, a closing spring support bracket 15 is provided to support the other end of the opposite side of the end portion that provides the driving force.

The switching mechanism of the air circuit breaker according to the related art comprises a charging cam 2 for providing a driving force for charging elastic force of the closing spring unit, and the charging cam 2 is rotatable together with the rotational shaft 2*a*. The charging cam 2 includes a cam roller 2*b* indicated as a dotted line on one side thereof as shown in FIG. 2.

The third link 3 is coaxially connected with the rotational shaft 2*a* of the charging cam 2 and rotatable together.

A pair of driving levers 16 include a driving lever pin 16*b* that contacts with the second link 4. The pair of driving levers 16 are separately connected by the driving lever pin 16*b*, and the second and third links 4 and 3 are interposed between the pair of levers 16. The driving levers 16 can be connected with the closing spring unit to provide a driving force for charging elastic energy to the closing spring unit, or can be rotatable upon receiving charged elastic energy from the closing spring unit.

A breaking spring 14 is provided such that one end thereof is supported by the main shaft lever 10-*a* and the other end is supported by a spring support pin (reference numeral is not given) fixed on the side plate 1. During a closing operation, the breaking spring 14 is stretched according to clockwise direction of the main shaft lever 10-1 to charge elastic energy, and when a circuit is broken, the breaking spring 14 discharges the charged elastic energy to provide a driving force for rotating the main shaft lever 10-1 counterclockwise.

A pair of third link bias springs 15 are provided. One end of each third link bias spring 15 is supported by the driving lever pin 16*b* of the driving levers 16 and the other end of each third link bias spring 15 is supported by the driving connection pin (P) that connects the second and third links 4 and 3.

The driving connection pin (P) penetrates the second and third links to connect them, and extends to be protruded to support the pair of third link bias springs 15 at both ends.

In order to prevent interference by the protruded driving connection pin (P), the pair of driving levers 16 are separated by the driving lever pin 16*b* with a considerably long distance therebetween.

A closing latch 5 extends long in a vertical direction in order to have one surface positioned on a moving locus of the cam roller 2*b* provided on one surface of the charging cam 2, and can latch a rotation of the charging cam 2. An upper end portion of the closing latch 5 is positioned on a rotating path of an on-shaft 8, so it can be latched or released by the on-shaft 8.

The on-shaft 8 is connected with an on-button (not shown) so as to be rotated manually or automatically rotated by being connected with an electrical driving control device or an actuator.

A recess 3*a* is formed at an upper portion of the third link 3, an opening latch roller 7*a* is provided at a position at which it can enter the recess 3*a* of the third link or released therefrom. An opening latch 7 that can be rotatable centering around a rotational shaft 7*b* is provided at an upper portion of the third link 3. One end of the opening latch 7 is connected with an opening latch spring 7*c* by a pin to thus receive an elastic bias force for rotation counterclockwise in FIGS. 1 and 2 from the opening latch spring 7*c*.

An off-shaft 9 is provided to contact with the other end of the opening latch 7 in a lengthwise direction, and the rotation of the opening latch 7 is latched or released by the off-shaft 9.

The operation of the switching mechanism of the air circuit breaker according to the related art constructed as described can be divided into the elastic energy charging operation, the closing operation and the opening operation of the closing spring and will be described as follows.

First, the charging operation of the closing spring will be described with reference to FIG. 3.

The rotational shaft 2*a* of the charging cam 2 is rotated by an operating handle (not shown) or a driving motor (not shown) counterclockwise on the drawing.

Then, the driving lever roller 16*a* of the driving lever 16 contacting with an outer circumferential surface of the charging cam 2 is compressed as a curvature radius of the outer circumferential surface of the charging cam 2 is reduced to press the spring seat of the closing spring unit that contacts with and pressed by the driving lever roller 16*a* to compress the closing spring 13.

At this time, as the charging cam 2 is rotated, the driving lever roller 16*a* rolls along the outer circumferential surface of the charging cam 2, and the charging cam 2 is rotated until the cam roller 2*b* provided at one surface of the charging cam 2 contacts with the closing latch 5.

As the charging cam 2 is rotated counterclockwise, the third link 3, the second link 4 and the driving lever 16 interlock to be rotated counterclockwise.

At this time, rotation of the main shaft 10 is latched by the opening latch 7, so that it is maintained to be separated from the movable contactor 11 and the stationary contactor 12 as shown in FIG. 1.

As the third link 3 is rotated counterclockwise, the roller 7*a* of the opening latch 7 is received in the recess portion 3*a* of the third link 3 and the counterclockwise rotation of the third link 3 is latched.

When the cam roller 2*b* provided on one surface of the charging cam 2 contacts with the closing latch 5, it pushes the closing latch 5, making the closing latch 5 be rotated in clockwise direction centering around its rotational shaft. The clockwise rotation of the closing latch 5 is restraining by the on-shaft 8, and the charging operation of the closing spring 13 is completed.

The closing operation of the switching mechanism of the air circuit breaker according to the related art will now be described with reference to FIG. 4.

When the on-shaft 8 is connected with an ON-button (not shown) and rotated manually or when the on-shaft 8 is connected with the electrical driving control device or the actuator and automatically rotated, the closing latch 5 is released from the on-shaft 8 and rotated clockwise.

As the closing latch 5 is released, the cam roller 2*b* is also released from the closing latch 5.

Accordingly, the driving lever roller 16*a* which has restraining discharging of elastic energy of the closing spring 13 while contacting with the outer circumferential surface of the charging cam 2 gets out of the outer circumferential surface of the charging cam 2.

As the closing spring 13 is discharged, the driving lever 16 is pressed by the spring seat of the closing spring 13 and rotated counterclockwise, and accordingly, the driving lever pin 16*b* pushes the second link 4 to rotate it counterclockwise. Then, the third link 3 is rotated counterclockwise according to the counterclockwise rotation of the second link 4, and accordingly, the first link 6 is pushed up by the second link 4 and rotated counterclockwise.

The main shaft lever 10-1 and the first link 6 are connected with each other for interlocking, so that as the first link 6 is rotated counterclockwise, the main shaft lever 10-1 is rotated clockwise and the main shaft 10 is also rotated clockwise. Accordingly, the movable contactor 11 interlocked with the main shaft lever 10-1 is rotated counterclockwise on the drawing and comes in contact with the stationary contactor 12 and thus the circuit is closed.

At this time, the breaking spring 14 is in a stretched state, storing (charging) the elastic energy.

The circuit opening operation of the switching mechanism of the air circuit breaker according to the related art will now be described with reference to FIG. 1.

When the off-shaft 9 is connected with the OFF-button (not shown) and rotated clockwise manually or when the off-shaft 9 is connected with the electrical driving control device and the actuator and rotated clockwise automatically, the opening latch 7 is released from the latched state by the off-shaft 9 and rotated counterclockwise due to elastic force of the opening latch spring 7*c*, and also released from the latched state by the recess portion 3*a* of the third link 3.

As the third link 3 is released from the latched state by the opening latch 7, the interlocked second and first links 4 and 6 are also released, and in a state that the opening spring 14 is stretched while closing operation, a support end portion of the main shaft lever 10-1 is returned to the spring support pin of the side plate 1 to discharge the charged elastic energy to thus rotate the main shaft lever 10-1 counterclockwise. Accordingly, the movable contactor 11 is rotated clockwise and separated from the stationary contactor 12. Thus, the circuit is opened.

However, in the switching mechanism of the air circuit breaker according to the related art, as shown in FIG. 8, one end of each of the pair of third link bias springs 15 is supported by the driving lever pin 16*b* of the driving lever 16 and the other end of each of the pair of third link bias springs 15 is supported by the driving connection pin (P) that connects the second and third links 4 and 3.

The driving connection pin (P) penetrates the second and third links to connect them, and extends to be protruded to support the pair of third link bias springs 15 at both ends.

In order to prevent interference by the protruded driving connection pin (P), the pair of driving levers 16 are separated by the driving lever pin 16*b* with a considerably long distance therebetween.

Thus, because the space between the pair of driving levers 16 becomes away, the distance between the both side plates 1 is increased, the width of the switching mechanism of the air circuit breaker is increased, and the air circuit breaker is increased in size.

SUMMARY OF THE INVENTION

Therefore, in order to address the above matters the various features described herein have been conceived. One aspect of the exemplary embodiments is to provide a switching mechanism of an air circuit breaker that allows the overall size of the air circuit breaker to be minimal by making the width of the switching mechanism relatively small.

This specification provides a switching mechanism of an air circuit breaker including a stationary contactor connected with a current conducting line and a movable contactor movable to a closing position at which the movable contactor contacts with the stationary contactor or to an opening position at which the movable contactor is separated from the stationary contactor, in which the switching mechanism switches the movable contactor, that comprises:

both side plates that support the switching mechanism;

a main shaft that extends to penetrate the both side plates and provides a driving force for simultaneously driving 3-phase movable contactors;

a main shaft lever that has one end connected with the main shaft and the other end connected with the movable contactor and is rotated in the same direction as that of the main shaft;

a first link which has one end connected with the main shaft lever, is rotated in the opposite direction as that of the main shaft lever, and provides a driving force for driving the movable contactor to the closing or opening position;

a second link which has one end connected with the other end of the first link and is rotatable in the same direction as that of the first link;

a closing spring unit that has one position of charging elastic energy or the other position of providing a driving force for driving the movable contactor to an closing position by discharging the charged elastic energy;

a charging cam that provides a driving force for charging an elastic force of the closing spring unit;

a rotational shaft of the charging cam;

a third link which has one end connected with the other end of a second link by a driving connection pin to transfer a driving force to the second link, and is coaxially connected with the rotational shaft of the charging cam so as to be rotatable together;

a driving lever which includes a driving lever pin contacting with the second link and a pair of levers separately connected by the driving lever pin, the second link and a third link being interposed between the pair of levers, and which is connected with the closing spring unit to provide a driving force for charging an elastic energy to the closing spring unit, or is rotatable upon receiving the charged elastic energy from the closing spring unit;

a spring support pin which is protruded from the side plate and fixed at the side plate; and a third link elastic bias spring which includes an end portion supported by the spring support pin and an operation portion for providing an elastic force onto one surface of the third link to bias the third link to be rotated in one direction, and which minimizes the width of the switching mechanism by minimizing the distance between the pair of driving levers through providing the elastic force to the third link directly.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 12 and 13 are views showing the structure of a charging cam, links and a link elastic bias spring in the switching mechanism of the air circuit breaker according to the present invention, in which FIG. 12 is a perspective view of the charging cam and the links in the switching mechanism of the air circuit breaker according to the present invention; and FIG. 13 is a perspective view showing the third link elastic bias spring in the switching mechanism of the air circuit breaker according to the present invention.

DETAILED DESCRIPTION OF THE INVENTION

Figure 1:
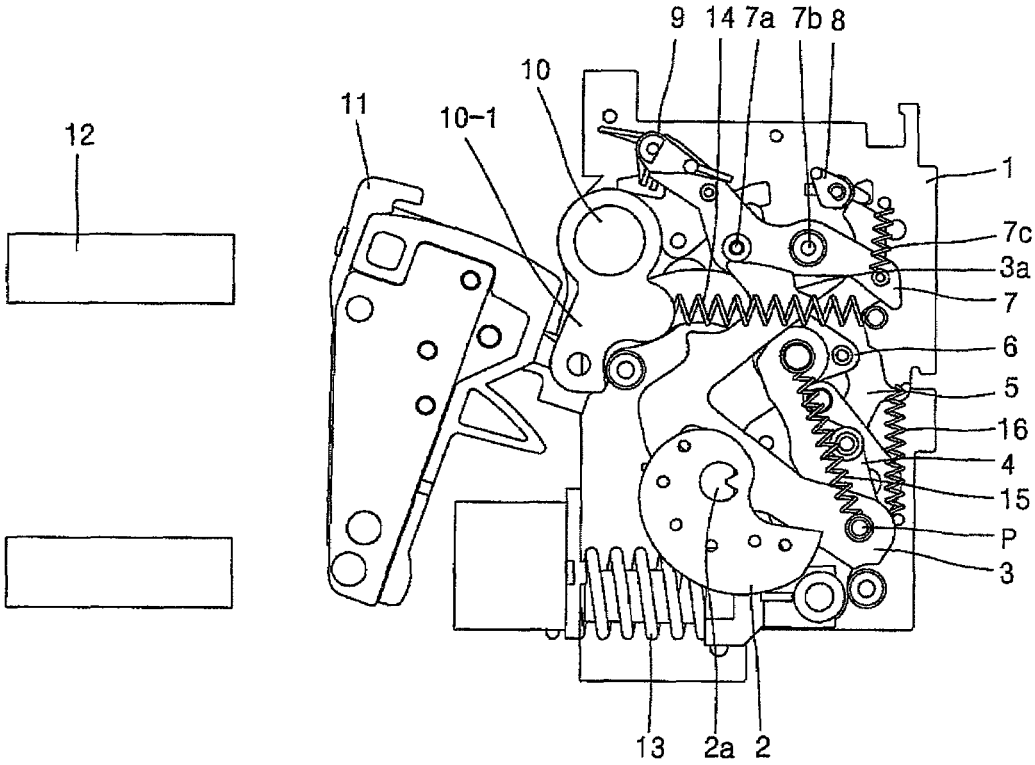
FIG. 1 RELATED ART
FIG. 1 is a front view showing an initial state (opening state) of a switching mechanism of an air circuit breaker without one side plate according to the related art.
Figure 2:
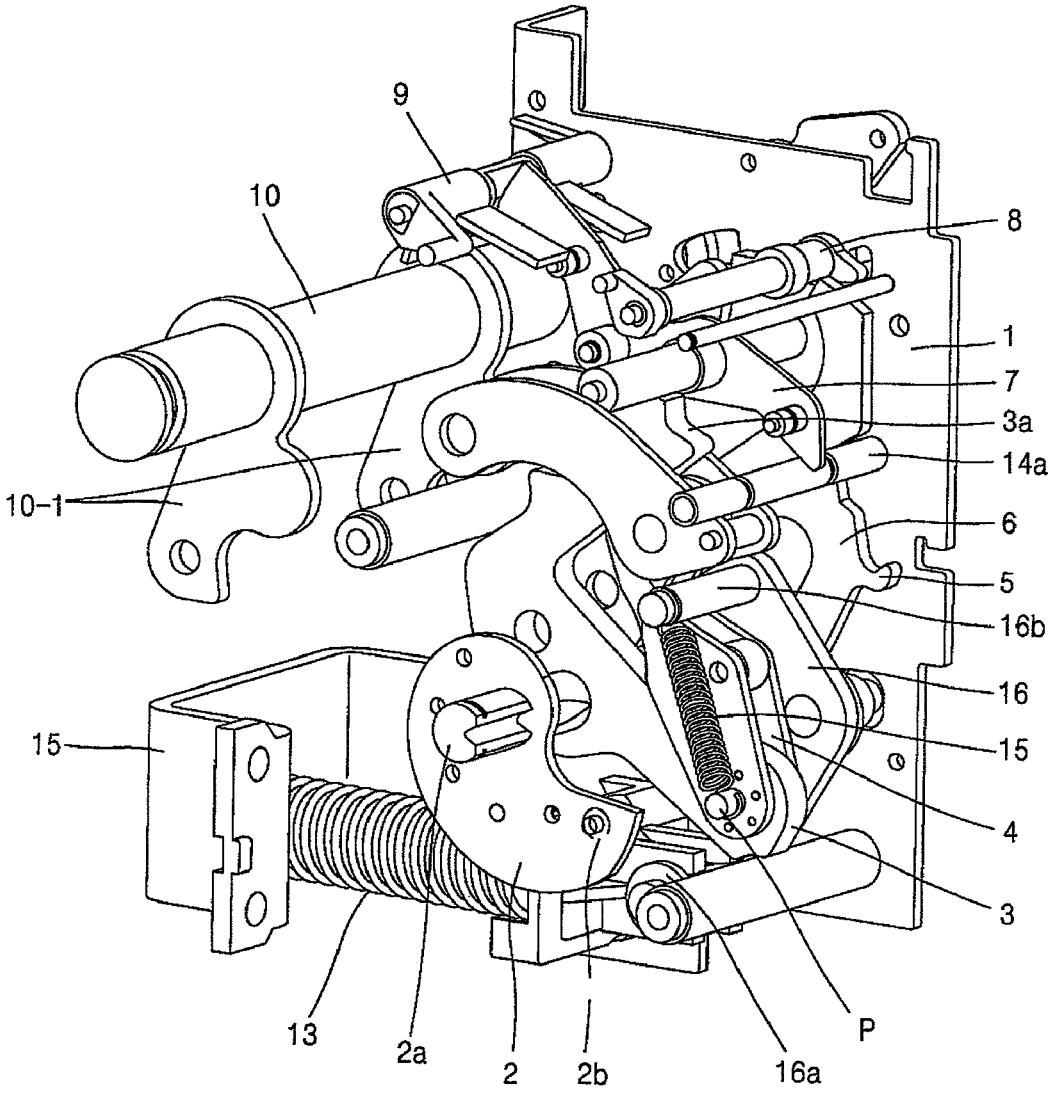
FIG. 2 RELATED ART
FIG. 2 is a perspective view showing the construction of the switching mechanism of the air circuit breaker without one side plate according to the related art.
Figure 3:
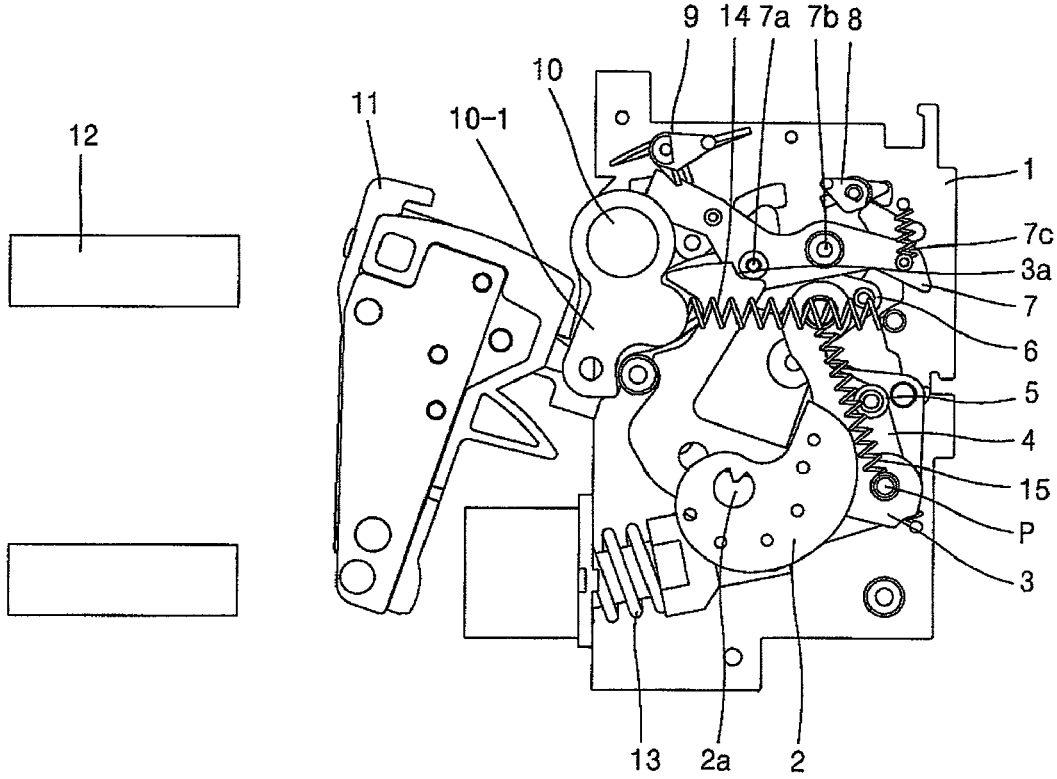
FIG. 3 RELATED ART
FIG. 3 is a view showing a state that a closing spring is charged in the switching mechanism of the air circuit breaker according to the related art.
Figure 4:
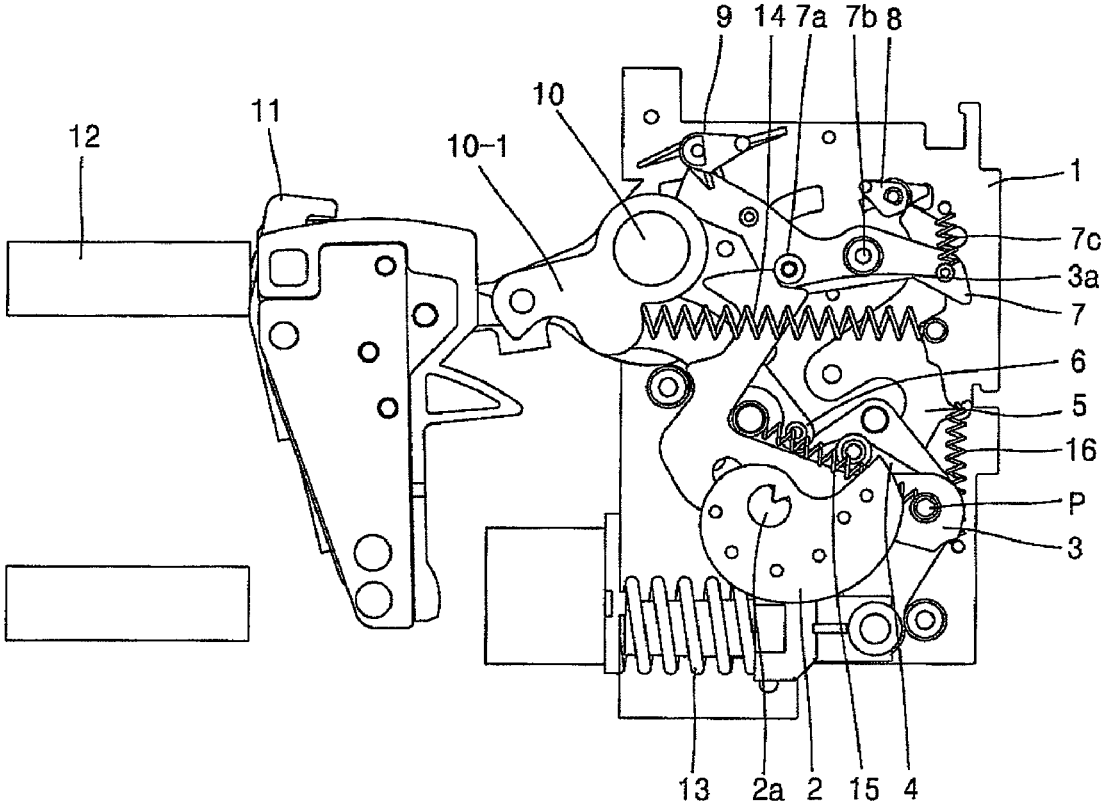
FIG. 4 RELATED ART
FIG. 4 is a view showing a state that closing is completed in the switching mechanism of the air circuit breaker according to the related art.
Figure 5:
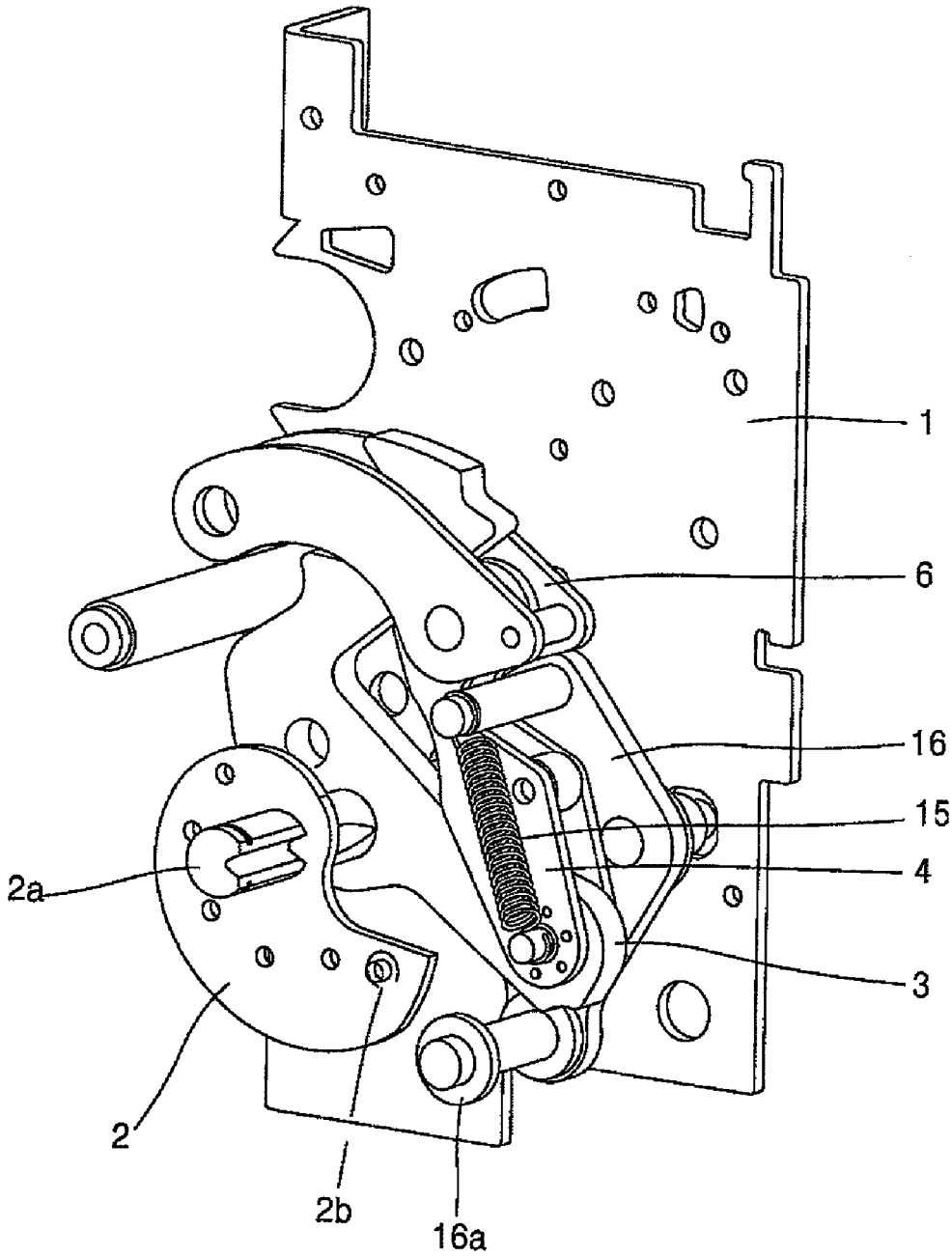
FIG. 5 RELATED ART
FIG. 5 is a partial perspective view showing the structure of a charging cam, links and a third link elastic bias spring in the switching mechanism of the air circuit breaker according to the related art.

The object, the construction for achieving the object, and an operational effect of the present invention will be clearly understood through the following description on the embodiment of the present invention made with reference to FIGS. 6 to 13.

For the sake of convenience in understanding the present invention in comparison with the related art, elements of a switching mechanism according to the present invention which perform the same or similar functions are given the same reference numerals, and a description will be made rather than being omitted although it is repeated.

Figure 6:
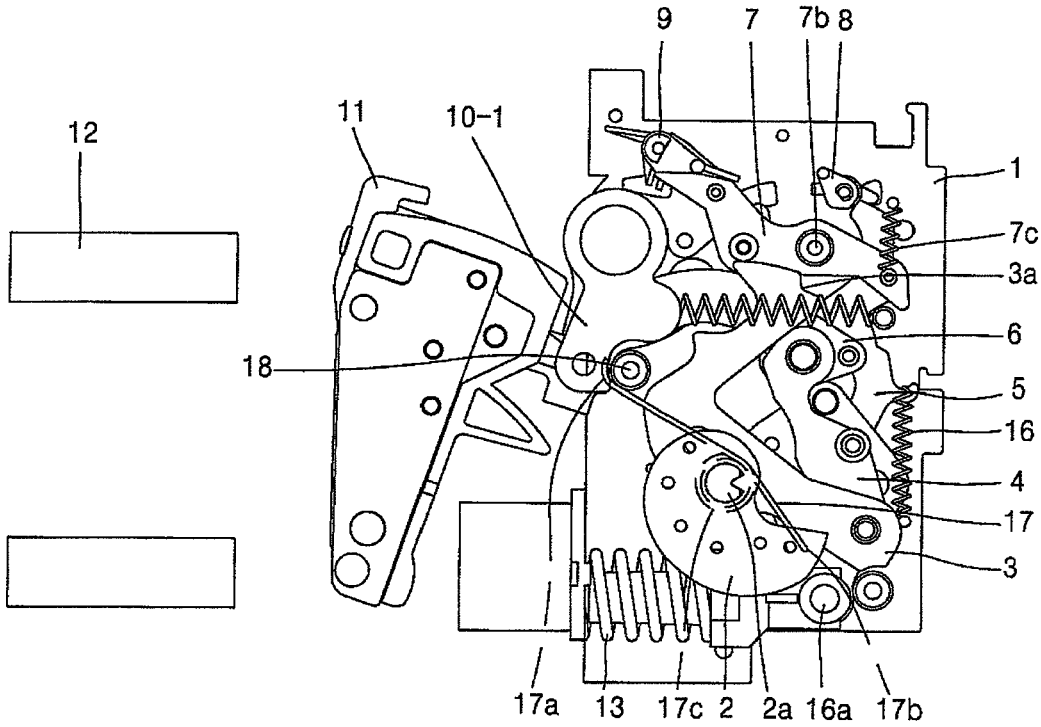
FIG. 6 is a front view showing an initial state (opening state) of a switching mechanism of an air circuit breaker without one side plate according to the present invention.
Figure 7:
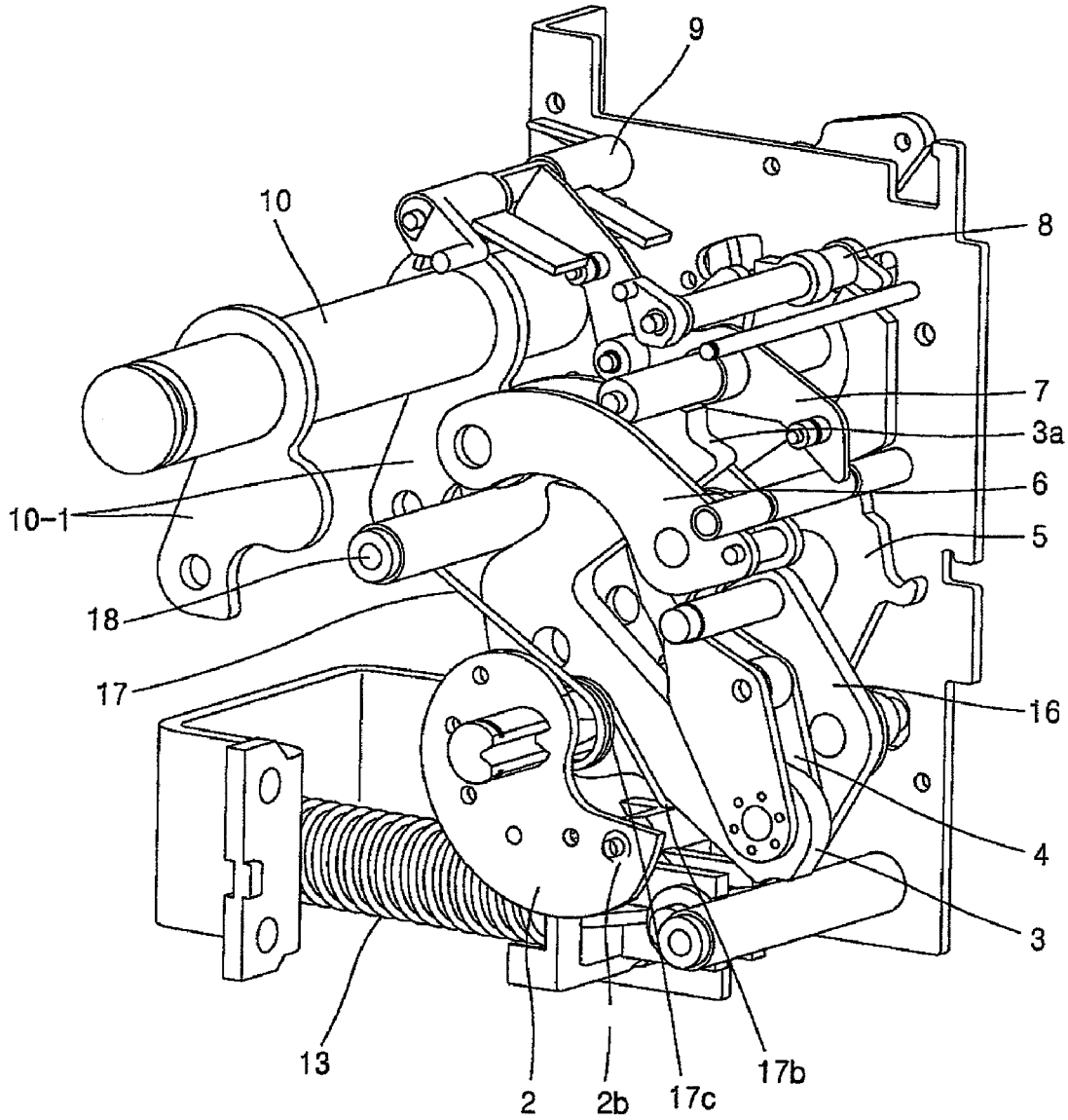
FIG. 7 is a perspective view showing the construction of the switching mechanism of the air circuit breaker without on side plate according to the present invention.
Figure 8:
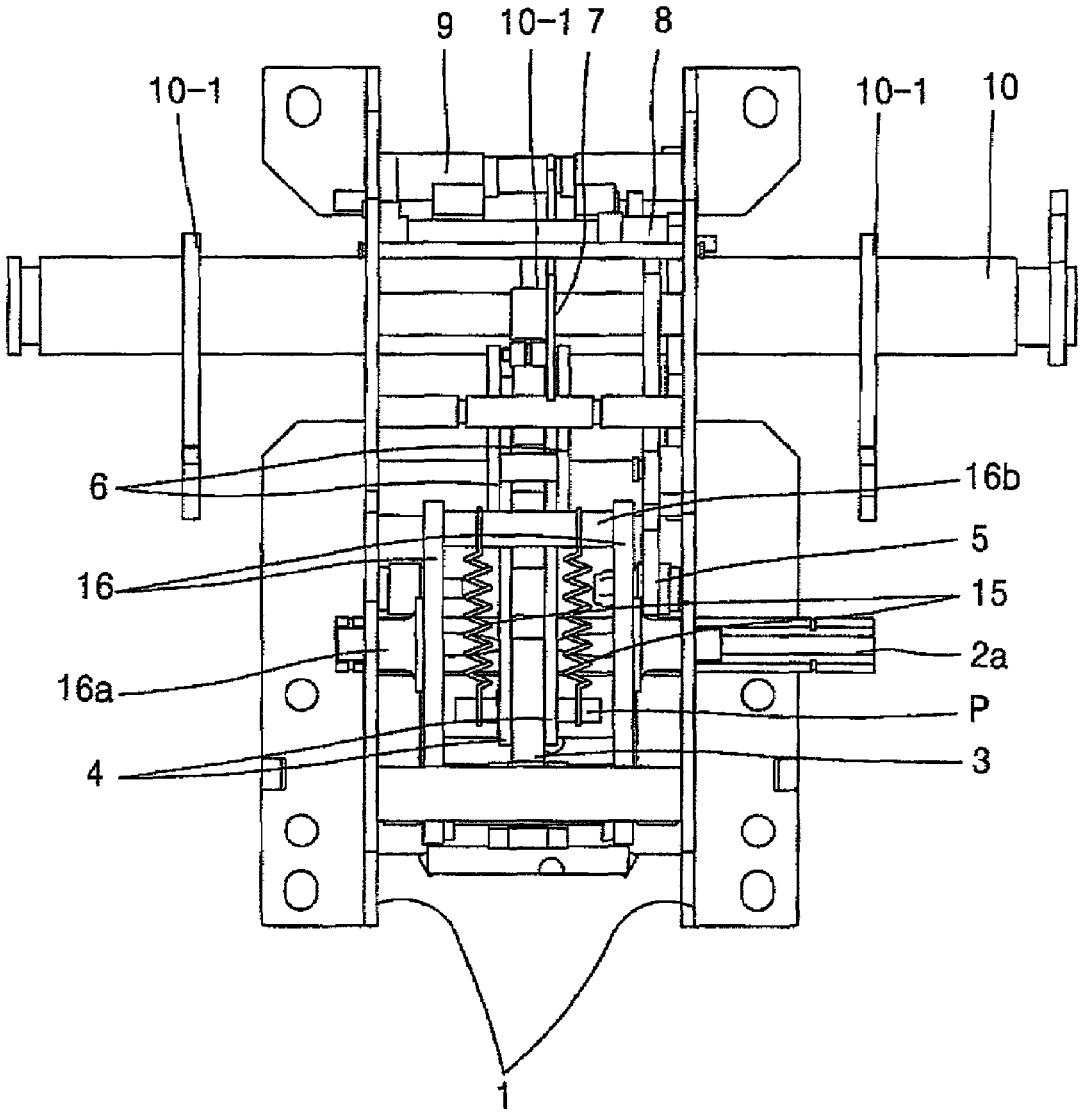
FIG. 8 RELATED ART
FIGS. 8 and 9 are side views for showing the comparison between the construction of the switching mechanism with the reduced width of the air circuit breaker according to the present invention and the switching mechanism according to the related art.
Figure 9:
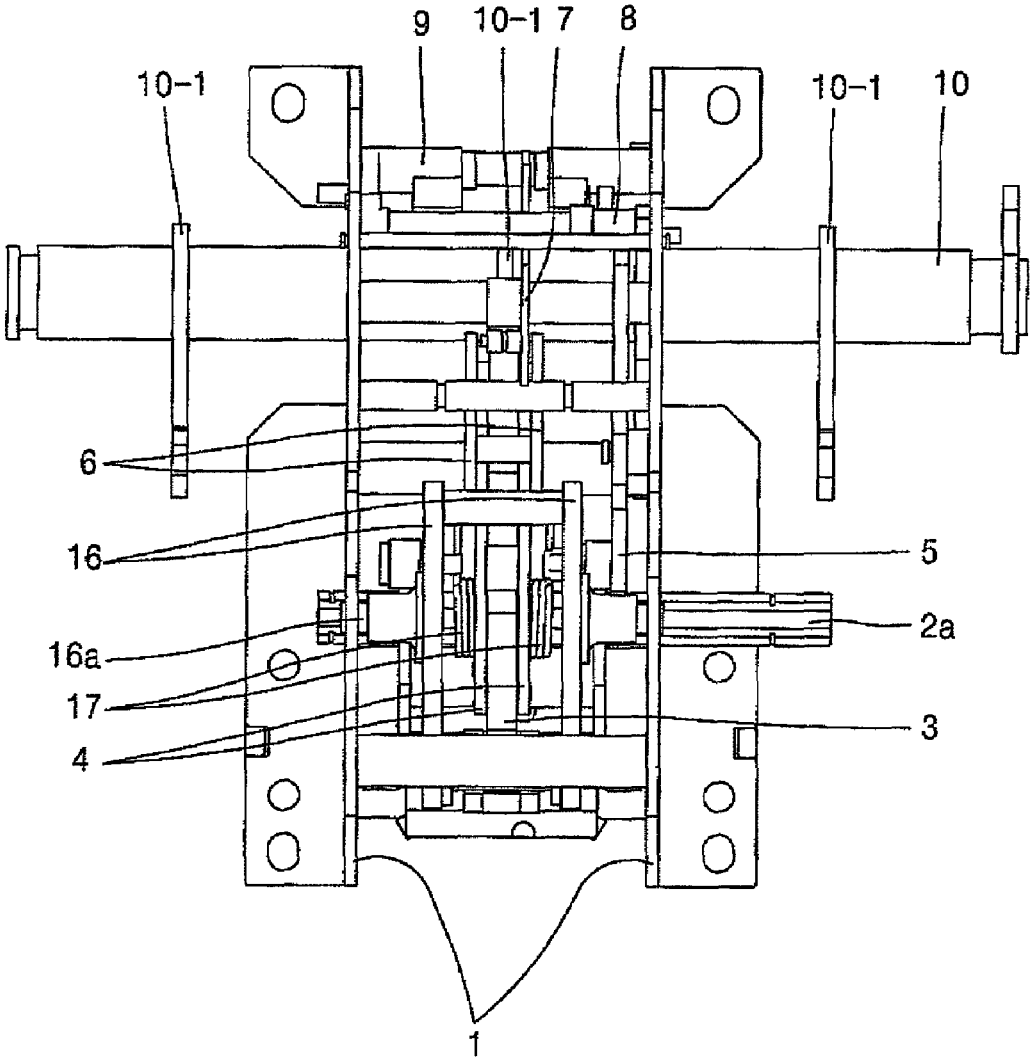

Like the switching mechanism of the air circuit breaker according to the related art as described above with reference to FIG. 1, the switching mechanism of an air circuit breaker according to the present invention as shown in FIGS. 6 and 7 includes: a stationary contactor 12 and a movable contactor 11 which is movable to a closing position at which the movable contactor 11 contacts with the stationary contactor 12 to close the current conduction circuit or a breaking (trip) position at which the movable contactor 11 is separated from the stationary contactor 12 to open the current conduction circuit.

As shown in FIG. 6, the movable contactor 11 is connected with a main shaft lever 10-1 and driven such that it comes in contact with the stationary contactor 12 or separated from the stationary contactor 12 according to a rotational direction of the main shaft lever 10-1.

The main shaft lever 10-1 is generally used when the air circuit breaker opens and closes 3 phases alternating current conducting lines, so three main shaft levers 10-1 are provided to correspond to each phase and drive the movable contactor 11 of a corresponding phase.

In order to simultaneously drive the three main shaft levers 10-1, the respective main shaft levers 10-1 are coaxially connected with a single common main shaft 10.

Accordingly, the main shaft 10 penetrates both side plates 1 supporting the switching mechanism so as to extend to be connected with the main shaft lever 10-1 of a different phase.

Among the main shaft levers 10-1, the central main shaft lever 10-1 connected with the switching mechanism has one end connected with the main shaft 10 and the other end connected with a first link 6.

Like gears which have a different rotational shaft with the main shaft lever 10-1 and are in mesh with each other, one end of the first link 6 is connected with the main shaft lever 10-1, and the main shaft lever 10-1 and the first link 6 are rotated in the mutually opposite directions. The first link 6 provides a driving force to the central main shaft lever 10-1, among the three main shaft levers 10-1, to make the central main shaft lever 10-1 to drive the movable contactor 11 to an opening or closing position.

A second link 4 is connected with the other end of the first link 6, and the first and second links 6 and 4 are rotated in the same direction.

One end of a third link 3 is rotatably provided at the other end of the second link 4 and connected by a driving connection pin (P) to transfer the driving force to the second link 4.

A closing spring unit includes a closing spring 13 for providing a driving force to drive the movable contactor 11 to the closing position and a closing spring seat which is not reference numeral designated. The closing spring 13 charges elastic energy or discharges it to provide a driving force to drive the movable contactor 11 to the closing position.

In order to prevent the closing spring 13 from being released and support the rotation of the closing spring seat, a closing spring support bracket 15 is provided to support the other end of the opposite side of the end portion that provides the driving force.

The switching mechanism of the air circuit breaker according to the present invention comprises a charging cam 2 for providing a driving force for charging elastic force of the closing spring unit, and the charging cam 2 is rotatable together with the rotational shaft 2*a*. The charging cam 2 includes a cam roller 2*b* indicated as a dotted line on one side thereof as shown in FIG. 7.

The third link 3 is coaxially connected with the rotational shaft 2*a* of the charging cam 2 and rotatable together.

A pair of driving levers 16 include a driving lever pin 16*b* that contacts with the second link 4. The pair of driving levers 16 are separately connected by the driving lever pin 16*b*, and the second and third links 4 and 3 are interposed between the pair of levers 16. The driving levers 16 can be connected with the closing spring unit to provide a driving force for charging elastic energy to the closing spring unit, or can be rotatable upon receiving charged elastic energy from the closing spring unit.

The switching mechanism of the air circuit breaker according to the present invention includes a spring support pin 18 protrusively fixed at the side plate 1.

As shown in FIGS. 10 to 13, a third link elastic bias spring 17 of the switching mechanism of the air circuit breaker according to the present invention includes an end portion 17*a* supported by the spring support pin 18 and an operation portion 17*b* providing elastic force onto one surface (namely, a lower surface) of the third link 3 to bias the third link 3 to be rotated in one direction. As noted in FIG. 9, the third link elastic bias spring 17 according to the present invention directly provides the elastic force to the third link 3 to minimize a space between the pair of driving levers 16 to thus minimize the width of the switching mechanism.

Preferably, the third link elastic bias spring 17 is formed as a torsion spring which includes the end portion 17*a* supported by the spring support pin 18, the operation portion 17*b* for providing elastic force for rotation in one direction onto the third link 3, and a central portion 17*c* wound on the rotational shaft 2*a* of the charging cam 2.

The one direction in which the third link elastic bias spring 17 acts on one surface (the lower surface) of the third link 3 is a direction in which the third link 3 drives the movable contactor 11 to the closing position. Namely, the one direction is the counterclockwise direction on the drawing, and accordingly, the interlocked second link 4 and the first link 6 are also rotated counterclockwise while the main shaft lever 10-1 and the main shaft 10 are rotated clockwise. The movable contactor 11 is rotated counterclockwise to the closing position at which it contacts with the stationary contactor 12.

More preferably, the third link elastic bias spring 17 can be formed as a double torsion spring including both end portions supported by the spring support pin 18, the operation portion 17*b* for providing elastic force for rotation in one direction onto the third link 3, and a pair of central portions 17*c* wound on the rotational shaft 2*a* of the charging cam 2.

The closing latch 5 extends long in a vertical direction in order to have one surface positioned on a moving locus of the cam roller 2*b* provided on one surface of the charging cam 2, and latches rotation of the charging cam 2. An upper end portion of the closing latch 5 is positioned on a rotating path of an on-shaft 8, so it can be latched or released by the on-shaft 8.

The on-shaft 8 is connected with an on-button (not shown) so as to be rotated manually or automatically rotated by being connected with an electrical driving control device or an actuator.

A recess portion 3*a* is formed at an upper portion of the third link 3, an opening latch roller 7*a* is provided at a position at which it can enter the recess portion 3*a* of the third link or released therefrom. An opening latch 7 that can be rotatable centering around a rotational shaft 7*b* is provided at an upper portion of the third link 3. One end of the opening latch 7 is connected with an opening latch spring 7*c* by a pin to thus receive an elastic bias force for rotation counterclockwise in FIGS. 6 and 7 from the opening latch spring 7*c*.

An off-shaft 9 is provided to contact with the other end of the opening latch 7 in a lengthwise direction, and the rotation of the opening latch 7 is latched or released by the off-shaft 9.

The operation of the switching mechanism of the air circuit breaker according to the related art constructed as described can be divided into the elastic energy charging operation, the closing operation and the opening operation of the closing spring and will be described as follows.

Figure 10:
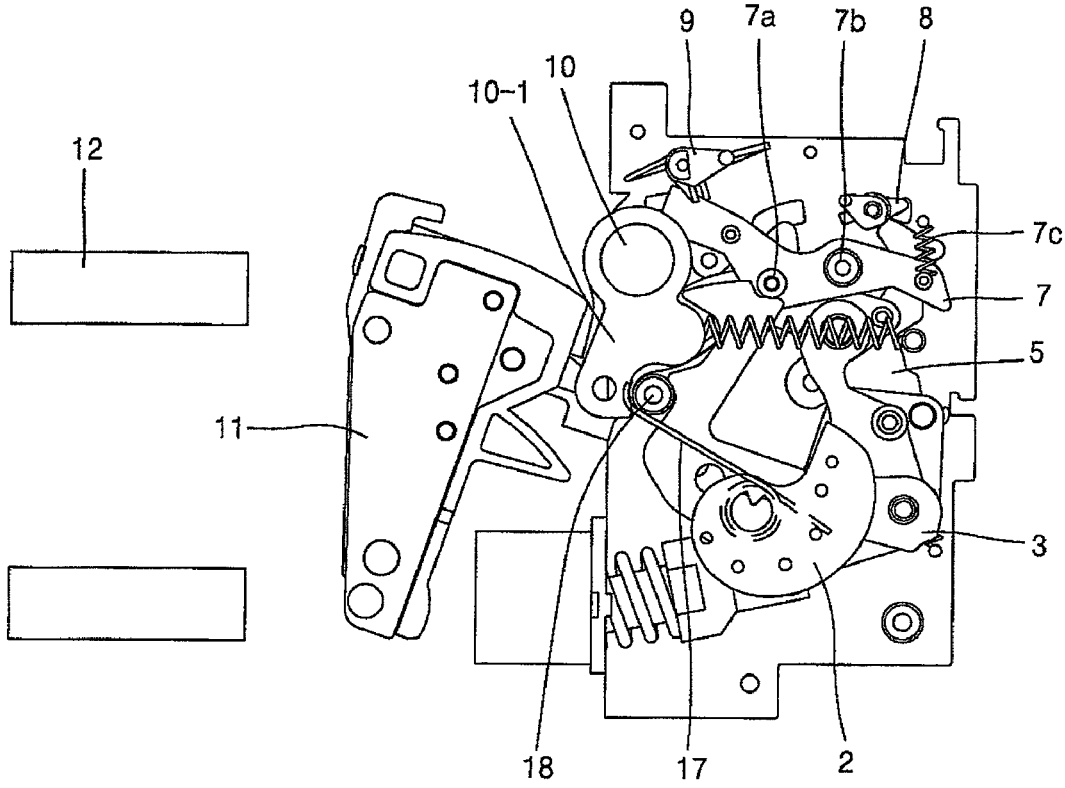
FIG. 10 is a view showing a state that a closing spring of the switching mechanism of the air circuit breaker is charged according to the present invention.

First, the charging operation of the closing spring will be described with reference to FIG. 10.

The rotational shaft 2*a* of the charging cam 2 is rotated by an operation handle (not shown) or a driving motor (not shown) counterclockwise on the drawing.

Then, the driving lever roller 16*a* of the driving lever 16 contacting with an outer circumferential surface of the charging cam 2 is pressed as a curvature radius of the outer circumferential surface of the charging cam 2 is reduced to press the spring seat of the closing spring unit that contacts with and pressed by the driving lever roller 16*a* to compress the closing spring 13.

At this time, as the charging cam 2 is rotated, the driving lever roller 16*a* rolls along the outer circumferential surface of the charging cam 2, and the charging cam 2 is rotated until the cam roller 2*b* provided at one surface of the charging cam 2 contacts with the closing latch 5.

As the charging cam 2 is rotated counterclockwise, the third link 3, the second link 4 and the driving lever 16 interlock to be rotated counterclockwise.

At this time, rotation of the main shaft 10 is latched by the opening latch 7, so that it is maintained to be separated from the movable contactor 11 and the stationary contactor 12 as shown in FIG. 6.

As the third link 3 is rotated counterclockwise, the roller 7*a* of the opening latch 7 is received in the recess 3*a* of the third link 3 and the counterclockwise rotation of the third link 3 is latched.

When the cam roller 2*b* provided on one surface of the charging cam 2 contacts with the closing latch 5, it pushes the closing latch 5, making the closing latch 5 be rotated centering around its rotational shaft. The clockwise rotation of the closing latch 5 is restraining by the on-shaft 8, and the charging operation of the closing spring 13 is completed.

Figure 11:
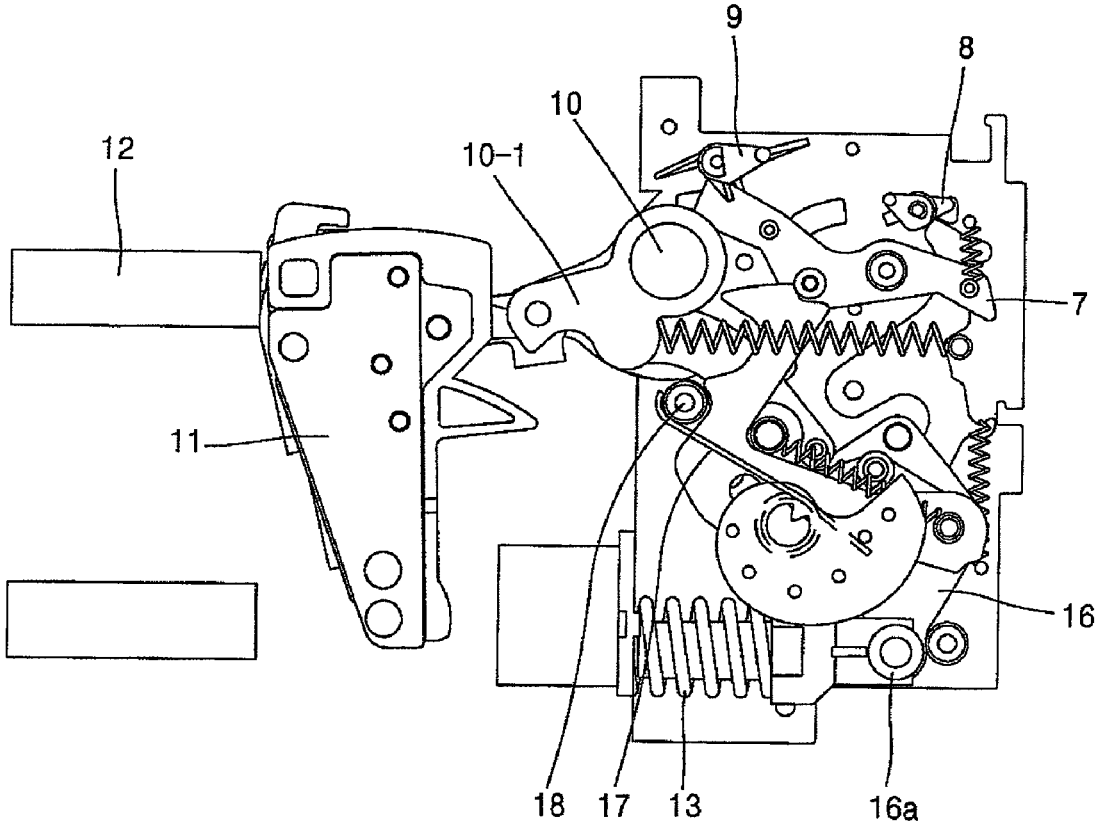
FIG. 11 is a view showing a state that closing is completed in the switching mechanism of the air circuit breaker according to the present invention.
Figure 12:
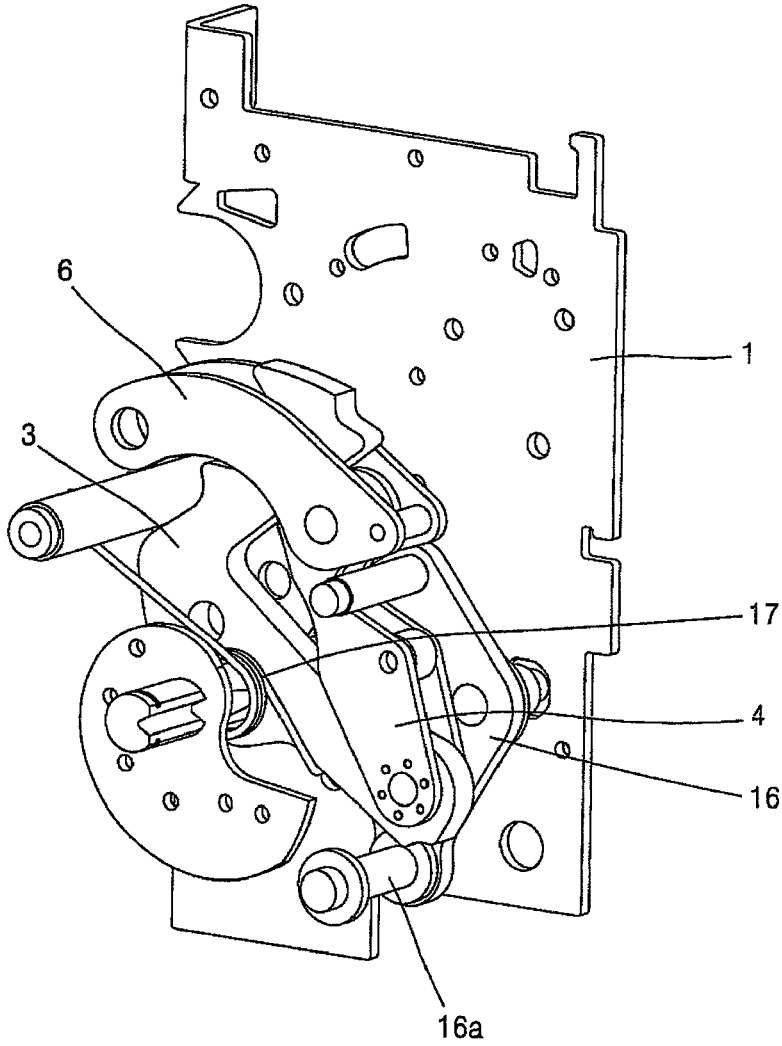
Figure 13:
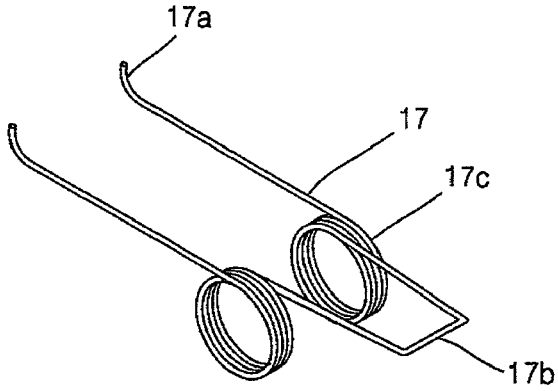

The closing operation of the switching mechanism of the air circuit breaker according to the related art will now be described with reference to FIG. 11.

When the on-shaft 8 is connected with an ON-button (not shown) and rotated manually or when the on-shaft 8 is connected with the electrical driving control device or the actuator and automatically rotated, the closing latch 5 is released from the on-shaft 8 and rotated clockwise.

As the closing latch 5 is released, the cam roller 2*b* is also released from the closing latch 5.

Accordingly, the driving lever roller 16*a* which has restraining discharging of elastic energy of the closing spring 13 while contacting with the outer circumferential surface of the charging cam 2 gets out of the outer circumferential surface of the charging cam 2.

As the closing spring 13 is discharged, the driving lever 16 is pressed by the spring seat of the closing spring 13 and rotated counterclockwise, and accordingly, the driving lever pin 16*b* pushes the second link 4 to rotate it counterclockwise. Then, the third link 3 is rotated counterclockwise according to the counterclockwise rotation of the second link 4, and accordingly, the first link 6 is pushed up by the second link 4 and rotated counterclockwise.

The main shaft lever 10-1 and the first link 6 are connected with each other to interlock, so that as the first link 6 is rotated counterclockwise, the main shaft lever 10-1 is rotated clockwise and the main shaft 10 is also rotated clockwise. Accordingly, the movable contactor 11 connected with the main shaft lever 10-1 to interlock is rotated counterclockwise on the drawing and comes in contact with the stationary contactor 12 and thus the circuit is closed.

The circuit opening operation of the switching mechanism of the air circuit breaker according to the related art will now be described with reference to FIG. 6.

When the off-shaft 9 is connected with the OFF-button (not shown) and rotated clockwise manually or when the off-shaft 9 is connected with the electrical driving control device and the actuator and rotated clockwise automatically, the opening latch 7 is released from the latched state by the off-shaft 9 and rotated counterclockwise due to elastic force of the opening latch spring 7*c*, and also released from the latched state by the recess 3*a* of the third link 3.

As the third link 3 is released from the latched state by the opening latch 7, the interlocked second and first links 4 and 6 are also released, and in a state that the opening spring 14 is stretched while closing operation, a support end portion of the main shaft lever 10-1 is returned to the spring support pin of the side plate 1 to discharge the charged elastic energy to thus rotate the main shaft lever 10-1 counterclockwise. Accordingly, the movable contactor 11 is rotated clockwise and separated from the stationary contactor 12. Thus, the circuit is opened.

As so far described, the switching mechanism of the air circuit breaker according to the present invention has the following advantages.

That is, compared with the related art in which the two springs are provided and one end of each spring is supplied by the driving lever and the other end of each spring is supported by both ends of the driving connection pins of the third and second links, to work, in the present invention, the third link elastic bias spring that elastically biasing the third link in one direction has one end for directly providing the elastic bias force onto one surface of the third link and the other end supported by the pin fixed on the side plate, not the driving lever.

That is, unlike the construction of the related art in which the support pin is protruded and the pin of the driving lever needs to extend to support the two springs, in the present invention, the space between the driving levers can be reduced to reduce the width of the switching mechanism, resulting in the reduction of the size of the air circuit breaker.

Such effect can be increased by forming the third link elastic bias spring as the torsion spring or the double torsion spring.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A switching mechanism of an air circuit breaker including a stationary contactor connected with a current conducting line and a movable contactor movable to a closing position at which the movable contactor contacts with the stationary contactor or to an opening position at which the movable contactor is separated from the stationary contactor, in which the switching mechanism switches the movable contactor to the closing position or the opening position, the switching mechanism comprising:

both side plates that support the switching mechanism;

a main shaft that extends to penetrate the both side plates and provides a driving force for simultaneously driving 3-phase movable contactors;

a main shaft lever that has one end connected with the main shaft and the other end connected with the movable contactor and is rotated in the same direction as that of the main shaft;

a first link which has one end connected with the main shaft lever, is rotated in the opposite direction as that of the main shaft lever, and provides a driving force for driving the movable contactor to the closing or opening position;

a second link which has one end connected with the other end of the first link and is rotatable in the same direction as that of the first link;

a closing spring unit that has one position of charging elastic energy or the other position of providing a driving force for driving the movable contactor to an closing position by discharging the charged elastic energy;

a charging cam that provides a driving force for charging an elastic force of the closing spring unit;

a rotational shaft of the charging cam;

a third link which has one end connected with the other end of the second link by a driving connection pin to transfer a driving force to the second link, and is coaxially connected with the rotational shaft of the charging cam so as to be rotatable together;

a driving lever which includes a driving lever pin contacting with the second link and a pair of levers separately connected by the driving lever pin, the second link and a third link being interposed between the pair of levers, and which is connected with the closing spring unit to provide a driving force for charging an elastic energy to the closing spring unit, or is rotatable upon receiving the charged elastic energy from the closing spring unit;

a spring support pin which is protruded from the side plate and fixed at the side plate; and a third link elastic bias spring which includes an end portion supported by the spring support pin and an operation portion for providing an elastic force onto one surface of the third link to bias the third link to be rotated in one direction, and which minimizes the width of the switching mechanism by minimizing the distance between the pair of driving levers through providing the elastic force to the third link directly.

2. The mechanism of claim 1, wherein the third link elastic bias spring is a torsion spring that comprises an end portion supported by the spring support pin, an operation portion for providing elastic force for rotation in one direction onto the third link, and a central portion wound on the rotational shaft of the charging cam.

3. The mechanism of claim 1, wherein the one direction in which the third link elastic bias spring acts on one surface of the third link is a direction in which the third link drives the movable contactor to the closing position.

4. The mechanism of claim 1, wherein the third link elastic bias spring is a double torsion spring that comprises both end portions supported by the spring support pin, the operation portion for providing elastic force for rotation in one direction to the third link, and a pair of central portions wound on the rotational shaft of the charging cam.

* * * * *